US005802874A

United States Patent [19]

Voit

[11] Patent Number: 5,802,874

[45] Date of Patent: Sep. 8, 1998

[54] PROCESS AND APPARATUS FOR LIQUEFYING LOW BOILING GAS SUCH AS NITROGEN

[75] Inventor: Jürgen Voit, Schondorf, Germany

[73] Assignee: Linde Aktiengesellschaft, Hoellriegelskreuth, Germany

[21] Appl. No.: 810,764

[22] Filed: Mar. 5, 1997

[30] Foreign Application Priority Data

Mar. 11, 1996 [DE] Germany ..... 196 09 489.5

[51] Int. Cl.[6] ..... F25J 3/00

[52] U.S. Cl. ..... 62/650; 62/912

[58] Field of Search ..... 62/606, 649, 650, 62/651, 912

[56] References Cited

U.S. PATENT DOCUMENTS

| | | | |
|---|---|---|---|
| 2,496,380 | 2/1950 | Crawford | 62/912 X |
| 3,194,025 | 7/1965 | Grossmann . | |
| 3,285,028 | 11/1966 | Newton | 62/650 X |
| 3,677,019 | 7/1972 | Olszewski . | |
| 4,894,076 | 1/1990 | Dobracki et al. | 62/650 |

FOREIGN PATENT DOCUMENTS

| | | | |
|---|---|---|---|
| 3-168583 | 7/1991 | Japan | 62/650 |
| 1023352 | 3/1996 | United Kingdom | 62/650 |
| WO90/08295 | 7/1990 | WIPO . | |

OTHER PUBLICATIONS

European Search Report Aug. 26, 96.

*Primary Examiner*—Christopher Kilner
*Attorney, Agent, or Firm*—Evenson, McKeown, Edwards & Lenahan, P.L.L.C.

[57] ABSTRACT

A process and apparatus are used for liquefying a low-boiling gas, 1, 507, particularly nitrogen. Gas to be liquified is cooled 12 under an increased pressure, is expanded 14 and is then obtained as a liquid product 16. In a refrigeration cycle, cycle medium is compressed to a first pressure 4, 6, 8, 10. A first partial flow 101 of the cycle medium is expanded while carrying out work in a first expansion machine 102. A second partial flow 201 of the cycle medium is cooled 12*a* and is expanded while carrying out work in a second expansion machine 202. In addition, a third partial flow 301 of the cycle medium is cooled and is expanded in a third expansion machine 302 while carrying out work. All three expansion machines 102, 202, 302 have essentially the same inlet pressure. The cooling of the gas to be liquified is carried out at least partially by the indirect heat exchange with expanded cycle medium 103, 203, 17 in a cycle heat exchanger 12. The outlet pressures of the three expansion machines 102, 202, 302 are essentially the same.

36 Claims, 2 Drawing Sheets

PROCESS AND APPARATUS FOR LIQUEFYING LOW BOILING GAS SUCH AS NITROGEN

BACKGROUND AND SUMMARY OF THE INVENTION

This application claims the priority of German Application No. 196 09 489.5, the disclosure of which is expressly incorporated by reference herein.

The invention relates to a process for liquefying a low-boiling gas, particularly nitrogen, in which gas to be liquified is cooled under an increased pressure, is expanded and is subsequently obtained as a liquid product, the process having a refrigeration cycle in which a cycle medium is compressed to a first pressure, a first partial flow of the cycle medium is expanded while carrying out work in a first expansion machine, a second partial flow of the cycle medium is cooled and is expanded while carrying out work in a second expansion machine, and also a third partial flow of the cycle medium is cooled and is expanded while carrying out work in a third expansion machine the inlet pressures and the outlet pressures of the three expansion machines being essentially equal and the cooling of the gas to be liquified being carried out at least partially by an indirect heat exchange with expanded cycle medium in a cycle heat exchanger.

Such processes are used, for example, for liquefying natural gas, nitrogen or oxygen. A three-turbine process of the initially mentioned type for liquefying natural gas or nitrogen is known from U.S. Pat. No. 3,677,019 (FIG. 6). In principle, the use of three turbines permits a relatively precise adaptation of the temperatures of flows to be cooled and warmed in the cycle heat exchanger. Nevertheless, the circuit known from the state of the art is not completely satisfactory in all cases.

It is an object of the invention to provide a process of the initially mentioned type and a corresponding apparatus which operate particularly advantageously with respect to energy and require relatively low expenditures with respect to the apparatus.

This object is achieved in that the outlet pressures of the expansion machines are essentially the same.

In this case, "essentially the same" applies to relative deviations of less than 10%. Slight deviations of pressures which are called "relatively the same" here may be caused particularly by flow resistances of pipes, heater exchanger passages, control valves or similar devices. However, the term is to exclude the use of pressure-changing devices, such as compressors or expansion valves.

In the case of the invention, all three turbines have essentially the same inlet pressure and essentially the same outlet pressure, whereas the inlet and the outlet temperatures can be adapted to the specific requirements of the temperature course in the cycle heat exchanger. Thus, on the one hand, all partial flows of the cycle medium can be compressed jointly; on the other hand, it was found that in this manner the exchange losses in the cycle heat exchanger can be kept particularly low.

In this case, it is advantageous for energy generated in one, several or all expansion machines to be used for the compression of the cycle medium to the first pressure. This takes place preferably in that one, several or all expansion machines are mechanically coupled with one secondary compressor respectively which contributes to the compression of the cycle medium to the first pressure. For example, the compression of the cycle medium can be carried out by an externally driven cycle compressor and three serially connected secondary compressors coupled with one expansion machine respectively.

In the case of the process according to the invention, it is advantageous for the cooling of the second and/or third partial flow to be carried out at least partially by the indirect heat exchange for expanded cycle medium in the cycle heat exchanger. Additional heat exchangers are not necessary. The operation of the cycle heat exchanger can be designed to be particularly economical.

Preferably, the inlet temperature $T_1$ of the first expansion machine is approximately the same as or lower than the temperature at the warm end of the cycle heat exchanger. The difference of these two temperatures is, for example, at 0 to 10%, preferably 0 to 5% of the difference of the temperatures at the warm and cold end of the cycle heat exchanger. It is most advantageous to branch off the first partial flow upstream of the introduction of the remaining cycle medium into the cycle heat exchanger and lead it approximately at an ambient temperature to the first expansion machine.

It is advantageous for the inlet temperature $T_2$ of the second expansion machine to be situated between the inlet temperature $T_1$ of the first expansion machine and the temperature at the cold end of the cycle heat exchanger. The difference $T_1$–$T_2$ is, for example, 10% to 50%, preferably 20 to 40% of the difference of the temperatures at the warm and cold end of the cycle heat exchanger.

The inlet temperature $T_3$ of the third expansion machine is higher than the temperature at the cold end of the cycle heat exchanger and is preferably between the inlet temperature $T_2$ of the second expansion machine and the temperature at the cold end of the cycle heat exchanger. The difference $T_2$–$T_3$ is, for example, 10% to 50%, preferably 20 to 40% of the difference of the temperatures on the warm and cold end of the cycle heat exchanger.

In the case of the invention, the gas to be liquified and the cycle medium may have the same chemical composition so that, at least partially, they can both be compressed jointly. Expenditures with respect to the apparatus can be saved as the result of separate compressor lines.

In addition, the invention relates to an apparatus for carrying out the described processes and uses of the processes and/or of the apparatus in preferred embodiments the connection between the outlets of the expansion machines and the inlet of the devices for compressing the cycle medium contain no devices for changing the pressure. Preferred embodiments are for systems for separation air by low-temperature certification, the gas to be liquified being formed by at least one of the products rectification in especially preferred embodiments the cycle medium is formed by nitrogen or air.

Other objects, advantages and novel features of the present invention will become apparent from the following detailed description of the invention when considered in conjunction with the accompanying drawings.

DETAILED DESCRIPTION OF THE DRAWINGS

Figure 1:
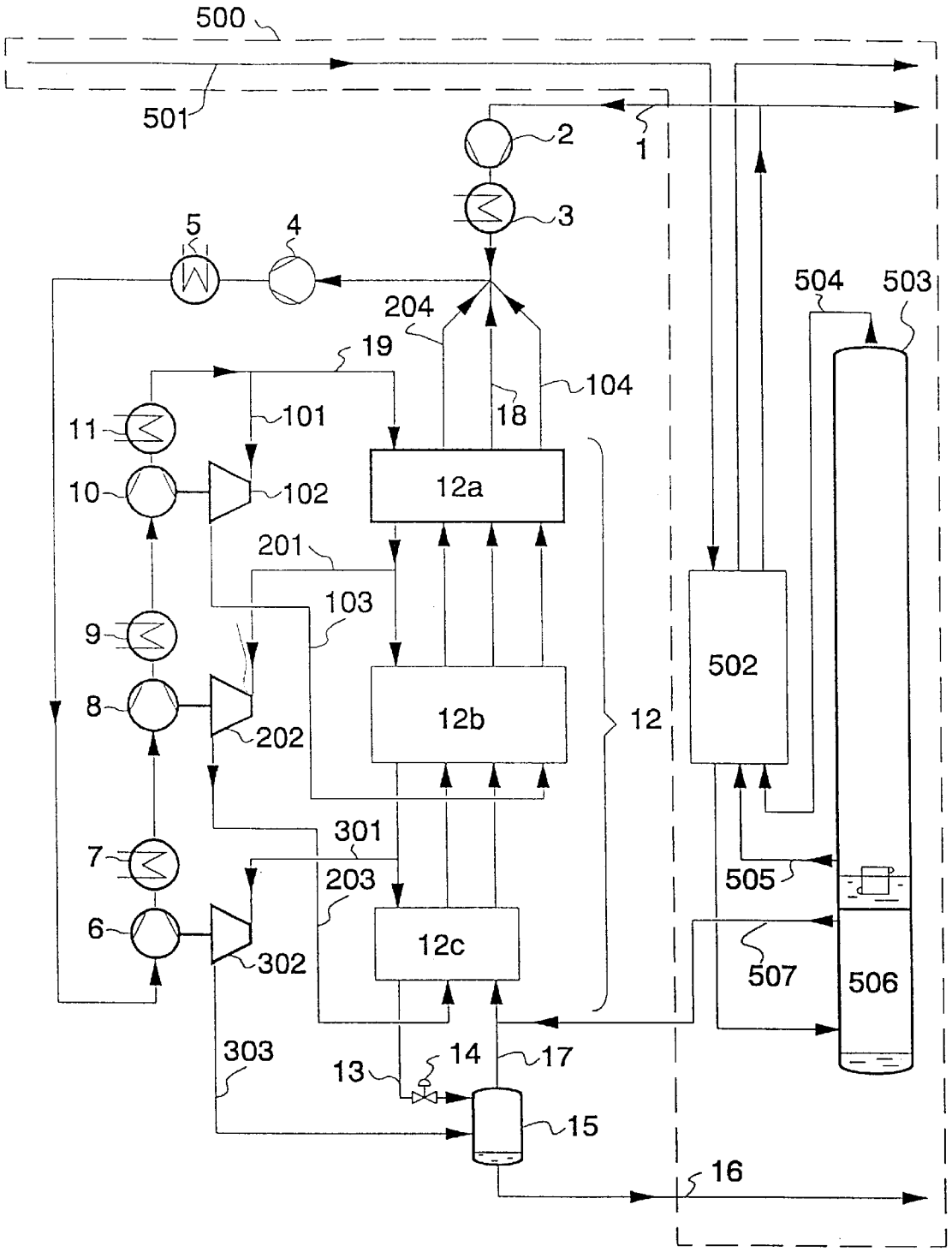
FIG. 1 is a schematic diagram showing a process and apparatus for liquefying nitrogen gas, in accordance with preferred embodiments of the present invention.

In the example shown, the gas 1 to be liquified is supplied by a system 500 for the cryogenic separation of air and consists of nitrogen. It is compressed to a first pressure in a feed gas compressor 2 and is then compressed to a second pressure in a cycle compressor 4 and three secondary compressors 6, 8, 10 and, under the high pressure, flows through a cycle heat exchanger 12 which consists of three sections 12*a*, 12*b*, 12*c*. After emerging from the cold end of the cycle heat exchanger 12 (pipe 13), the gas to be liquified is expanded to approximately the first pressure (inlet pressure of the cycle compressor 4) and is introduced into a separator 15. In the example shown, the expansion upstream of the separator is carried out by means of a throttle valve 14. Deviating therefrom, a liquid-type turbine can also be used (see Springmann, *Linde-Berichte* 43/1978, Illustration 7 on Page 28). Liquid 16 from the separator 15 is discharged as a liquid product and is introduced into a pipe system or into a storage tank. Flash gas from the separator 15 is introduced by way of the pipe 17 into the cycle heat exchanger 12, is reheated there and is then returned to the cycle compressor 18.

In the embodiment shown, the gas to be liquified and the cycle medium are, to a large extent, guided jointly. In particular, they are jointly compressed in the compressors 4, 6, 8, 10 from the first pressure to the second pressure. Before entering the cycle heat exchanger 12, a first partial flow 101 of the cycle medium is branched off; enters at a temperature $T_1$, which is essentially equal to the temperature at the warm end of the cycle heat exchanger, into the first expansion machine 102 and is expanded there to essentially the first pressure. The expanded first partial flow 103 is introduced at the cold end of the second section 12*b* into the cycle heat exchanger and supplies its low temperature to the gas to be cooled. By way of pipe 104, it finally flows back to the cycle compressor 4.

The remainder of the cycle medium is introduced together with the gas to be liquified in the cycle heat exchanger 12 (pipe 19). A second partial flow 201 of the cycle medium is taken at the cold end of the first section 12*a* out of the cycle heat exchanger and, at a temperature $T_2$, which is essentially equal to the temperature at the cold end of the first section 12*a*, enters into the second expansion machine 202 and is expanded there to essentially the first pressure. Close to the cold end of the coldest section, the expanded second partial flow 203 is introduced into the cycle heat exchanger and also supplies its low temperature to the gas to be cooled. By way of pipe 204, it flows back to the cycle compressor 4.

A third partial flow 301 of the cycle medium is taken at the cold end of the second section 12*b* out of the cycle heat exchanger and, at a temperature $T_3$, which is essentially equal to the temperature at the cold end of the second section 12*b*, enters into the third expansion machine 302 and is expanded there to essentially the first pressure. This can result in a slight liquid part (maximally approximately 15% by weight). As provided in the example, the separator 15, in which the liquid product also occurs, can be utilized for its separation. The largest portion of the expanded third partial flow flows by way of the pipes 17 and 18 through the cycle heat exchanger 12 back to the cycle compressor 4.

The compression of the cycle medium to the second pressure is partially caused by the secondary compressors 6, 8, 10 which are connected in series. These secondary compressors 6, 8, 10 are driven at least partially, preferably completely by the energy obtained in the turbines. A direct mechanical coupling of one secondary compressor respectively 6, 8, 10 with one of the expansion machines 302, 202, 102 respectively is particularly advantageous in this case.

The following table shows a concrete numerical example of the process illustrated in FIG. 1.

| Figure 1 | Quantity (mol/s) | Temperature (K) | Pressure (bar) |
|---|---|---|---|
| 1 | 296.22 | 298 | 1.05 |
| before 4 | 296.22 | 302 | 4.95 |
| 101 | 84.77 | 303 | 69.15 |
| 103 | 84.77 | 163.2 | 5.35 |
| 104 | 84.77 | 302 | 4.95 |
| 19 | 211.45 | 303 | 69.15 |
| 201 | 54.36 | 227.9 | 69.0 |
| 203 | 54.36 | 118.1 | 5.26 |
| 204 | 54.36 | 302 | 4.95 |
| 301 | 109.1 | 165.3 | 68.85 |
| 303 | 109.1 | 94.96 | 5.4 |
| 13 | 48.0 | 96.1 | 68.7 |
| 17 | 93.2 | 94.96 | 5.4 |
| 18 | 93.2 | 302 | 4.95 |
| 16 | 63.84 | 94.9 | 5.4 |

Figure 2:
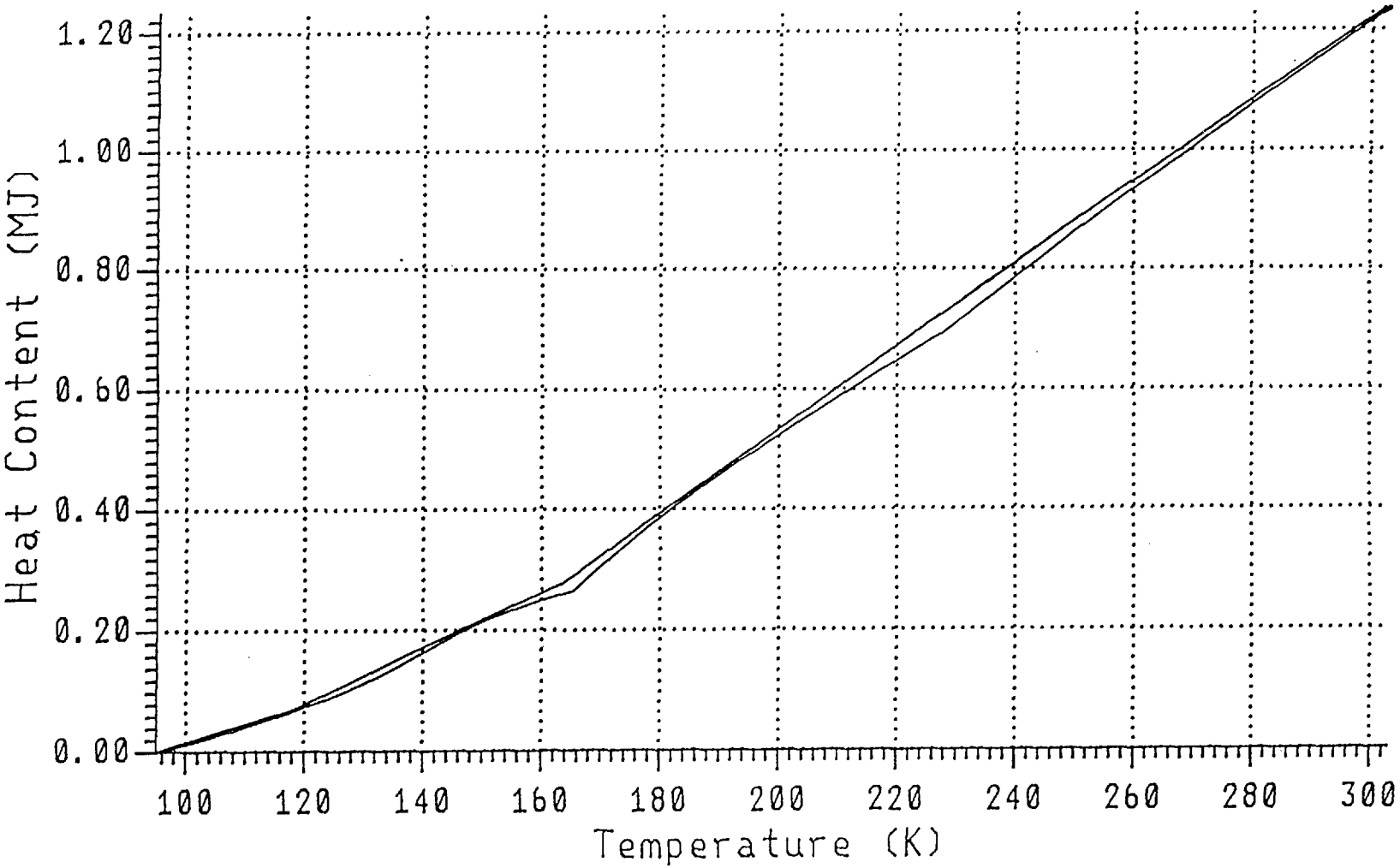
FIG. 2 is a graph showing the amount of heat transmitted in the cycle heat exchanges of FIG. 1 as a function of temperature.

FIG. 2 shows the amount of heat transmitted in the cycle heat exchanger 12 as a function of the temperature. The upper curve represents the sum of the flows to be heated; the lower curve represents the sum of the flows to be cooled. The good conformity of the course of the two curves clearly demonstrates the very low level of exchange losses achieved in the case of the liquefaction process according to the invention. This results in a process which is particularly advantageous with respect to energy.

In the air separation system 500, compressed and purified air 501 after a cooling against product flows is introduced in a main heat exchanger 502 into a rectifying column 503 which in the example is constructed as a double column. Low-pressure nitrogen 504 and high-oxygen product 505 are obtained from the upper part of the double column. At least a portion of the low-pressure nitrogen 504 forms at least one portion of the gas to be liquified. As an alternative or in addition, a nitrogen product 507 can be drawn off directly from the high-pressure part 506 of the column 503 (or possibly from a single column designed as a pressure column) and can completely or partially be fed at a suitable point into the liquefaction part. In the example, the lower level of the cycle (first pressure) is approximately equal to the rectifying pressure in the high pressure part 506 of the column 503.

The process-technical sections 12*a* to 12*c* of the cycle heat exchanger 12 can be implemented in different manners according to other contemplated embodiments of the invention. For example, each section can be implemented by precisely one heat exchanger block. However, it is also contemplated for one or several sections to consist of more than one block or for two sections or the whole cycle heat exchanger 12 to be constructed as one block. Turbines are preferably used as the expansion machines. One cooling-water-operated heat exchanger 3, 5, 7, 9, 11 respectively is connected behind each compressor 2, 4, 6, 8, 10, which heat exchanger brings the compressed gas to the temperature of the warm end of the cycle heat exchanger.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A process for liquefying a low-boiling gas, in which gas to be liquified is cooled under an increased pressure, is expanded and is subsequently obtained as a liquid product, comprising a refrigeration cycle in which a cycle medium is compressed to a first pressure, a first partial flow of the cycle medium is expanded while carrying out work in a first expansion unit, a second partial flow of the cycle medium is cooled and is expanded while carrying out work in a second expansion unit, and a third partial flow of the cycle medium is cooled and is expanded while carrying out work in a third expansion unit, the inlet pressures and the outlet pressures of the three expansion units being essentially equal and the cooling of the gas to be liquified being carried out at least partially by an indirect heat exchange with expanded cycle medium in a cycle heat exchanger, wherein the cooling of at least one of the second and third partial flow and the cooling of the gas to be liquified is carried out at least partially by an indirect heat exchange with expanded cycle medium in a co-current flow in the cycle heat exchanger, and wherein the outlet pressures of the expansion units are essentially the same.

2. Process according to claim 1, wherein the energy generated in at least one of the expansion machines is used for the compression of the cycle medium to the first pressure.

3. Process according to claim 2, wherein at least one of the expansion machines is mechanically coupled with one secondary compressor respectively which contributes to the compression of the cycle medium to the first pressure.

4. Process according to claim 1, wherein the inlet temperature of the first expansion machine is approximately the same or lower than the temperature at the warm end of the cycle heat exchanger.

5. Process according to claim 3, wherein the inlet temperature of the first expansion machine is approximately the same or lower than the temperature at the warm end of the cycle heat exchanger.

6. Process according to claim 1, wherein the inlet temperature of the second expansion machine is situated between the inlet temperature of the first expansion machine and the temperature at the cold end of the cycle heat exchanger.

7. Process according to claim 3, wherein the inlet temperature of the second expansion machine is situated between the inlet temperature of the first expansion machine and the temperature at the cold end of the cycle heat exchanger.

8. Process according to claim 4, wherein the inlet temperature of the second expansion machine is situated between the inlet temperature of the first expansion machine and the temperature at the cold end of the cycle heat exchanger.

9. Process according to claim 1, wherein the inlet temperature of the third expansion machine is situated between the inlet temperature of the second expansion machine and the temperature at the cold end of the cycle heat exchanger.

10. Process according to claim 3, wherein the inlet temperature of the third expansion machine is situated between the inlet temperature of the second expansion machine and the temperature at the cold end of the cycle heat exchanger.

11. Process according to claim 4, wherein the inlet temperature of the third expansion machine is situated between the inlet temperature of the second expansion machine and the temperature at the cold end of the cycle heat exchanger.

12. Process according to claim 6, wherein the inlet temperature of the third expansion machine is situated between the inlet temperature of the second expansion machine and the temperature at the cold end of the cycle heat exchanger.

13. Process according to claim 1, wherein the gas to be liquified and the cycle medium are jointly compressed at least partially.

14. Process according to claim 3, wherein the gas to be liquified and the cycle medium are jointly compressed at least partially.

15. Process according to claim 4, wherein the gas to be liquified and the cycle medium are jointly compressed at least partially.

16. Process according to claim 6, wherein the gas to be liquified and the cycle medium are jointly compressed at least partially.

17. Process according to claim 9, wherein the gas to be liquified and the cycle medium are jointly compressed at least partially.

18. Process according to claim 1, wherein said process is used in a system for separating air by low-temperature rectification, the gas to be liquified being formed by at least one of the products of the rectification.

19. Process according to claim 18, wherein the cycle medium is formed by one of nitrogen and air.

20. The process according to claim 1, wherein said low-boiling gas is nitrogen.

21. A process for liquefying a low-boiling gas in which gas to be liquified is cooled under an increased pressure, is expanded and is subsequently obtained as a liquid product, comprising:, a refrigeration cycle in which a cycle medium is compressed from a first pressure to a second pressure, a first partial flow of the cycle medium is expanded while carrying out work in a first expansion unit, a second partial flow of the cycle medium is cooled and is expanded while carrying out work in a second expansion unit, and a third partial flow of the cycle medium is cooled and expanded while carrying out work in a third expansion unit, the inlet pressures and the outlet pressures of the three expansion units being essentially equal and the cooling of the gas to be liquified being carried out at least partially by an indirect heat exchange with expanded cycle medium of a cycle heat exchanger, wherein the inlet temperature of at least one of the second and third expansion machines is between the inlet and the outlet temperature of the next adjacent warmer expansion machine.

22. A process according to claim 21, wherein the inlet temperature of the second expansion machine is between the inlet and the outlet temperature of the first expansion machine and the inlet temperature of the third expansion machine is between the inlet and the outlet temperature of the second expansion machine.

23. Process according to claim 21, wherein the outlet pressures of the expansion machines are essentially the same.

24. Process according to claim 21, wherein the energy generated in at least one of the expansion machines is used for the compression of the cycle medium to the first pressure.

25. Process according to claim 21, wherein at least one of the expansion machines is mechanically coupled with one secondary compressor respectively which contributes to the compression of the cycle medium to the first pressure.

26. Process according to claim 21, wherein the cooling of at least one of the second and third partial flow is carried out at least partially by an indirect heat exchange for expanded cycle medium in the cycle heat exchanger.

27. Process according to claim 21, wherein the inlet temperature of the first expansion machine is approximately the same or lower than the temperature at the warm end of the cycle heat exchanger.

28. Process according to claim 21, wherein the inlet temperature of the third expansion machine is situated between the inlet temperature of the second expansion machine and the temperature at the cold end of the cycle heat exchanger.

29. Process according to claim 21, wherein said process is used in a system for separating air by low-temperature rectification, the gas to be liquified being formed by at least one of the products of the rectification.

30. Process according to claim 29, wherein the cycle medium is formed by one of nitrogen and air.

31. The process according to claim 21, wherein said low-boiling gas is nitrogen.

32. An apparatus for liquefying a low-boiling gas, in which gas to be liquified is cooled under an increased pressure, is expanded and is subsequently obtained as a liquid product, comprising:

a refrigeration unit in which a cycle medium is compressed to a first pressure, a first expansion unit where a first partial flow of the cycle medium is expanded while carrying out work, a second expansion unit where a second partial flow of the cycle medium is cooled and is expanded while carrying out work, and a third expansion unit where a third partial flow of the cycle medium is cooled and is expanded while carrying out work, the inlet pressures and the outlet pressures of the three expansion units being essentially equal and a cycle heat exchanger where the cooling of the gas to be liquified is carried out at least partially by an indirect heat exchange with expanded cycle medium, wherein the cycle heat exchanger is adapted to cool at least one of the second and third partial flow and the gas to be liquified at least partially by an indirect heat exchange with expanded cycle medium in a co-current flow, and wherein the outlet pressures of the expansion units are essentially the same.

33. The apparatus of claim 32, wherein said low-boiling gas is nitrogen.

34. An apparatus for liquefying a low-boiling gas in which gas to be liquified is cooled under an increased pressure, is expanded and is subsequently obtained as a liquid product, comprising:

a refrigeration unit in which a cycle medium is compressed from a first pressure to a second pressure, a first expansion machine where a first partial flow of the cycle medium is expanded while carrying out work, a second expansion unit where a second partial flow of the cycle medium is cooled and is expanded while carrying out work, and a third expansion machine where a third partial flow of the cycle medium is cooled and is expanded while carrying out work, wherein the inlet pressures and the outlet pressures of the three expansion units are essentially equal and an indirect heat exchanger where the cooling of the gas to be liquified is carried out at least partially by an indirect heat exchange with expanded cycle medium, and wherein the inlet temperature of at least one of the second and third expansion units is between the inlet and the outlet temperature of the next adjacent warmer expansion unit.

35. Apparatus according to claim 34, wherein the inlet temperature of the second expansion machine is between the inlet and the outlet temperature of the first expansion machine and the inlet temperature of the third expansion machine is between the inlet and the outlet temperature of the second expansion machine.

36. The apparatus of claim 34, wherein said low-boiling gas is nitrogen.

* * * * *